US011111562B2

(12) United States Patent
Warner et al.

(10) Patent No.: US 11,111,562 B2
(45) Date of Patent: Sep. 7, 2021

(54) ALUMINUM-COPPER-LITHIUM ALLOY WITH IMPROVED MECHANICAL STRENGTH AND TOUGHNESS

(75) Inventors: Timothy Warner, Voreppe (FR); Christophe Sigli, Grenoble (FR); Cedric Gasqueres, Bourgoin-Jallieu (FR); Armelle Danielou, Les Echelles (FR)

(73) Assignee: CONSTELLIUM ISSOIRE, Issoire (FR)

( * ) Notice: Subject to any disclaimer, the term of this patent is extended or adjusted under 35 U.S.C. 154(b) by 323 days.

(21) Appl. No.: 12/820,495

(22) Filed: Jun. 22, 2010

(65) Prior Publication Data

US 2011/0030856 A1 Feb. 10, 2011
US 2011/0209801 A2 Sep. 1, 2011

Related U.S. Application Data

(60) Provisional application No. 61/220,249, filed on Jun. 25, 2009.

(51) Int. Cl.

| | |
|---|---|
| ***C22C 21/16*** | (2006.01) |
| ***C22F 1/057*** | (2006.01) |
| ***C22C 21/00*** | (2006.01) |
| ***C22F 1/04*** | (2006.01) |

(52) U.S. Cl.
CPC ..... *C22C 21/00* (2013.01); *C22C 21/16* (2013.01); *C22F 1/04* (2013.01); *C22F 1/057* (2013.01)

(58) Field of Classification Search
USPC ..... 148/417; 420/533, 539
See application file for complete search history.

(56) References Cited

U.S. PATENT DOCUMENTS

| | | | |
|---|---|---|---|
| 4,999,061 | A | 3/1991 | Curtis et al. |
| 5,018,612 | A | 5/1991 | Takikawa |
| 5,032,359 | A | 7/1991 | Pickens |

(Continued)

FOREIGN PATENT DOCUMENTS

| | | | |
|---|---|---|---|
| EP | 2 110 453 | A1 | 10/2009 |
| WO | 95 04837 | A1 | 2/1995 |

(Continued)

OTHER PUBLICATIONS

Davis, J.R. "Aluminum and Aluminum Alloys", ASM International, p. 45. (Year: 1993).*

(Continued)

*Primary Examiner* — George Wyszomierski
*Assistant Examiner* — Janell C Morillo
(74) *Attorney, Agent, or Firm* — McBee Moore & Vanik, IP, LLC

(57) ABSTRACT

The invention relates to a wrought product such as an extruded, rolled and/or forged aluminum alloy-based product, comprising, in weight %: Cu: 3.0-3.9; Li: 0.8-1.3; Mg: 0.6-1.0; Zr: 0.05-0.18; Ag: 0.0-0.5; Mn: 0.0-0.5; Fe+Si≤0.20; Zn≤0.15; at least one element from among: Ti: 0.01-0.15; Sc: 0.05-0.3; Cr: 0.05-0.3; Hf: 0.05-0.5; other elements ≤0.05 each and ≤0.15 total, remainder aluminum. The invention also relates to the process for producing said product. The products according to the invention are particularly useful in the production of thick aluminum products intended for producing structural elements in the aeronautical industry.

10 Claims, 4 Drawing Sheets

(56) References Cited

U.S. PATENT DOCUMENTS

| | | | | |
|---|---|---|---|---|
| 5,234,662 | A | 8/1993 | Balmuth | |
| 5,389,165 | A * | 2/1995 | Cho | 148/552 |
| 5,455,003 | A * | 10/1995 | Pickens et al. | 420/529 |
| 7,229,509 | B2 | 6/2007 | Cho | |
| 7,438,772 | B2 * | 10/2008 | Rioja et al. | 148/417 |
| 2004/0071586 | A1 | 4/2004 | Rioja et al. | |
| 2005/0006008 | A1 | 1/2005 | Cho | |
| 2009/0142222 | A1 | 6/2009 | Colvin | |

FOREIGN PATENT DOCUMENTS

| | | | |
|---|---|---|---|
| WO | 95 32074 | A2 | 11/1995 |
| WO | 2004 106570 | A1 | 12/2004 |
| WO | 2006 131627 | A1 | 12/2006 |
| WO | 2009 036953 | A1 | 3/2009 |
| WO | WO 2009036953 | A1 * | 3/2009 |

OTHER PUBLICATIONS

Alcan Aerospace: "2098-0/T82P A1-Li Fuselage sheets," Jun. 2007, XP002564468.

"International alloy designations and chemical composition limits for wrought aluminium and wrought aluminium alloys," Registration Record Series, Aluminum Association, Washington, DC, US, Jan. 1, 2004, pp. 1-26, XP002903949.

NASA-UVa Light Aerospace Alloy and Structures Technology Program Supplement: Aluminum-Based Materials for High Speed Aircraft, Semi-Annual Report, Feb. 1995.

Aluminum: Technology, Applications and Environment, sixth edition, 1998.

Easton, M.A., et al., "The Effect of Alloy Content on the Grain Refinement of Aluminium Alloys," Light Metals, TMS (The Minerals, Metals & Materials Society), pp. 927-933, 2001.

Stute, Ivo; Grounds for Opposition European Patent No. EP2449142A1 European Patent Application No. 10734173.7 Patent Holder: Constellium France; dated May 3, 2017.

* cited by examiner

ALUMINUM-COPPER-LITHIUM ALLOY WITH IMPROVED MECHANICAL STRENGTH AND TOUGHNESS

CROSS REFERENCE TO RELATED APPLICATIONS

This application claims priority to U.S. Provisional Application 61/220,249 filed Jun. 25, 2009 and FR 09/03096 filed Jun. 25, 2009, the contents of which are incorporated herein by reference in their entireties.

BACKGROUND OF THE INVENTION

Field of the Invention

The invention relates to aluminum-copper-lithium alloy products, and more specifically, such products and processes for production and use thereof, in particular in the field of aeronautical and aerospace construction.

Description of Related Art

Products, in particular thick rolled, forged or extruded aluminum alloy products, are developed in order to produce, by cutting, surface milling or machining from the solids, high-strength parts intended in particular for the aeronautical industry, the aerospace industry or mechanical construction.

Aluminum alloys comprising lithium are very beneficial in this regard because lithium can reduce the density of aluminum by 3% and increase the modulus of elasticity by 6% for each weight percent of lithium added. In order for these alloys to be selected in airplanes, their performance with respect to other usage properties must be as good as that of commonly used alloys, in particular in terms of the compromise between the static mechanical strength properties (yield strength, ultimate tensile strength) and the damage tolerance properties (fracture toughness, resistance to fatigue crack propagation), these properties generally being contradictory. For thick products, these properties must particularly be obtained at the quarter-and half-thickness, and the products therefore must have low quench sensitivity. It is said that a product is quench sensitive if these static mechanical properties, such as the yield strength, decrease when the quenching rate decreases. The quenching rate is the average cooling rate of the product during quenching.

These mechanical properties must also preferably be stable over time and not be significantly modified by aging at the working temperature. Thus, prolonged use of products in civil aviation applications requires good stability of the mechanical properties, which is simulated for example by thermal exposure for 1000 hours at 85° C.

These alloys must also have sufficient corrosion resistance, be capable of being formed according to usual processes and have low residual stress so as to be capable of being integrally machined.

U.S. Pat. No. 5,032,359 describes a very large family of aluminum-copper-lithium alloys in which the addition of magnesium and silver, in particular between 0.3 and 0.5 percent by weight, enables the mechanical strength to be increased.

U.S. Pat. No. 5,234,662 describes alloys with the following composition (in weight percent): Cu: 2.60-3.30, Mn: 0.0-0.50, Li: 1.30-1.65, Mg: 0.0-1.8, and elements controlling the granular structure chosen from Zr and Cr: 0.0-1.5.

U.S. Pat. No. 5,455,003 describes a process for producing Al—Cu—Li alloys that have improved mechanical strength and toughness at cryogenic temperature, in particular owing to suitable strain hardening and aging. This patent recommends in particular the following composition, in weight percentages: Cu: 3.0-4.5, Li: 0.7-1.1, Ag: 0-0.6, Mg: 0.3-0.6 and Zn: 0-0.75. The problem of thermal stability for civil aeronautics applications is not mentioned in said document because the intended applications are essentially cryogenic storages for rocket launchers or space shuttles.

U.S. Pat. No. 7,438,772 describes alloys comprising, in weight percentages: Cu: 3-5, Mg: 0.5-2, Li: 0.01-0.9 and discourages the use of higher lithium contents due to degradation of the compromise between toughness and mechanical strength.

U.S. Pat. No. 7,229,509 describes an alloy comprising (weight %): (2.5-5.5) Cu, (0.1-2.5) Li, (0.2-1.0) Mg, (0.2-0.8) Ag, (0.2-0.8) Mn, 0.4 max Zr or other grain-refining agents such as Cr, Ti, Hf, Sc or V, in particular having a toughness $K_{1C}(L)>37.4$ MPa√m for a yield strength of $R_{p0.2}(L)>448.2$ MPa (products with a thickness above 76.2 mm) and in particular a toughness $K_{1C}(L)>38.5$ MPa√m for a yield strength of $R_{p0.2}(L)>489.5$ MPa (products with a thickness below 76.2 mm). US Patent Application No 2009/142222 A1 describes alloys comprising (in weight %), 3.4 to 4.2% Cu, 0.9 to 1.4% Li, 0.3 to 0.7% Ag, 0.1 to 0.6% Mg, 0.2 to 0.8% Zn, 0.1 to 0.6% Mn and 0.01 to 0.6% of at least one element for controlling the granular structure.

Also known are alloy AA2050, which includes (weight %): (3.2-3.9) Cu, (0.7-1.3) Li, (0.20-0.6) Mg, (0.20-0.7) Ag, 0.25 max. Zn, (0.20-0.50) Mn, (0.06-0.14) Zr and alloy AA2095 (3.7-4.3) Cu, (0.7-1.5) Li, (0.25-0.8) Mg, (0.25-0.6) Ag, 0.25 max. Zn, 0.25 max. Mn, (0.04-0.18) Zr. Products of alloy AA2050 are known for their quality in terms of static mechanical strength and toughness.

There is a need for products, in particular thick products made of an aluminum-copper-lithium alloy having improved properties over those of known products, in particular in terms of compromise between properties of static mechanical strength and properties of damage tolerance, thermal stability, corrosion resistance and machinability, while having a low density.

SUMMARY OF THE INVENTION

The invention first relates to a wrought product such as an extruded, rolled and/or forged aluminum alloy-based product, comprising, in weight %:

Cu: 3.0-3.9;
Li: 0.8-1.3;
Mg: 0.6-1.0;
Zr: 0.05-0.18;
Ag: 0.0-0.5;
Mn: 0.0-0.5;
Fe+Si≤0.20;
Zn≤0.15;
at least one element among:
Ti: 0.01-0.15;
Sc: 0.05-0.3;
Cr: 0.05-0.3;
Hf: 0.05-0.5;
other elements ≤0.05 each and ≤0.15 total, remainder aluminum.

The invention secondly relates to a method to manufacture an extruded, rolled and/or forged aluminum alloy-based product in which:

a) an aluminum-based liquid metal bath is prepared, comprising 3.0 to 3.9% by weight Cu, 0.8 to 1.3% by weight Li, 0.6 to 1.0% by weight Mg, 0.05 à 0.18% by weight Zr, 0.0 to 0.5% by weight Ag, 0.0 to 0.5% by weight Mn, at most 0.20% by weight Fe+Si, at most 0.15% by weight Zn, at least one element chosen from among Cr, Sc, Hf and Ti, the amount of said element, if chosen, being from 0.05 to 0.3% by weight for Cr and for Sc, 0.05 to 0.5% by weight for Hf and 0.01 to 0.15% by weight for Ti, the other elements at most 0.05% by weight each, and 0.15% by weight in total, remainder aluminum;

b) an unwrought shape is cast from said liquid metal bath;

c) said unwrought shape is homogenized at a temperature of between 450° C. and 550° and preferably between 480° C. and 530° C. for a period of between 5 and 60 hours;

d) said unwrought shape is hot and optionally cold worked into an extruded, rolled and/or forged product;

e) said product is solution heat treated at between 490 and 530° C. for 15 min at 8 h and quenched;

f) said product is stretched in a controlled manner with a permanent set of 1 to 6% and preferably at least 2%;

g) said product is aged artificially, by heating at a temperature of from 130 to 170° C. for 5 to 100 hours and preferably from 10 to 40 h so as to obtain a yield strength close to the peak.

The invention also relates to a structural element comprising a product according to the invention.

The invention also relates to the use of a structural element according to the invention for aeronautical construction.

DETAILED DESCRIPTION OF A PREFERRED EMBODIMENT

Figure 1:
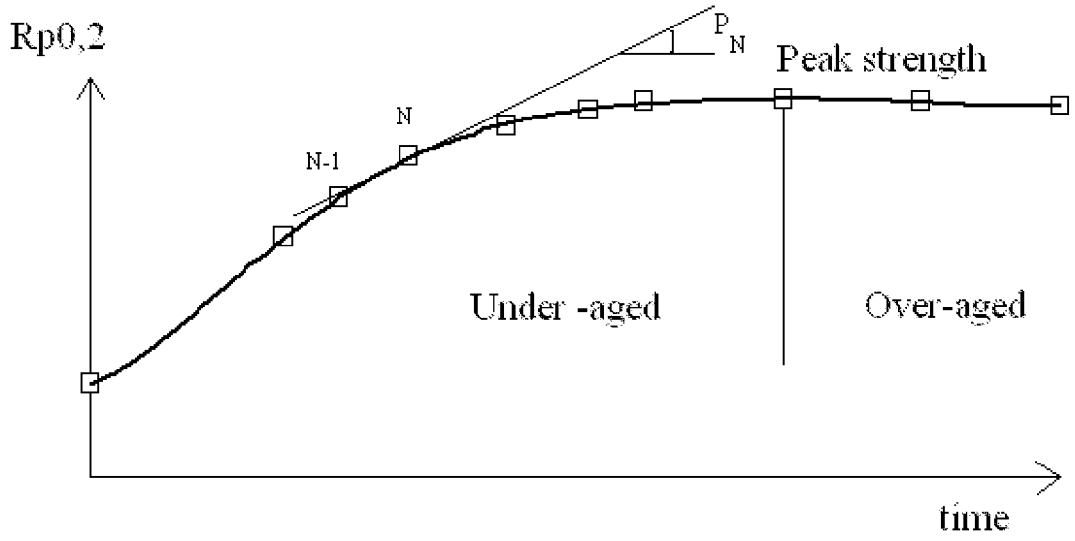
FIG. 1: Example of a curve of ageing and determination of the slope of the tangent $P_N$.

Unless otherwise indicated, all of the indications relating to the chemical composition of the alloys are expressed as a weight percentage based on the total weight of the alloy. The expression 1.4 Cu means that the copper content expressed in weight % is multiplied by 1.4. The alloys are designated according to the regulations of The Aluminum Association, known to a person skilled in the art. The density is dependent on the composition and is determined by calculation rather than by a weight measurement method. The values are calculated according to the procedure of The Aluminum Association, which is described on pages 2-12 and 2-13 of "Aluminum Standards and Data". The definitions of metallurgical tempers are indicated in the European standard EN 515.

Unless otherwise indicated, the static mechanical properties, in other words the ultimate tensile strength $R_m$, the conventional yield strength at 0.2% elongation $R_{p0.2}$ ("yield strength") and the elongation at rupture A %, are determined by a tensile test according to standard EN 10002-1, with the sample and the direction of the test being defined by standard EN 485-1.

The stress intensity factor ($K_Q$) is determined according to standard ASTM E 399. Standard ASTM E 399 gives criteria making it possible to determine whether $K_Q$ is a valid value of $K_{10}$. For a given test piece shape, the values of $K_Q$ obtained for different materials are comparable to one another insofar as the yield strengths of the materials are on the same order of magnitude.

Unless otherwise indicated, the definitions of standard EN 12258 apply. The thickness of the profiles is defined according to standard EN 2066:2001: the transverse cross-section is divided into basic rectangles with dimensions A and B; A is always the largest dimension of the basic rectangle and B can be considered to be the thickness of the basic rectangle. The die holder is the basic rectangle having the largest dimension A.

The MASTMAASIS (Modified ASTM Acetic Acid Salt Intermittent Spray) is performed according to standard ASTM G85.

In this document, the term "structure element" or "structural element" of a mechanical construction will refer to a mechanical part for which the static and/or dynamic mechanical properties are particularly important for the performance of the structure, and for which a structural calculation is normally prescribed or performed. This typically involves elements of which the failure is likely to endanger said construction, users thereof or others. For an airplane, these structural elements include in particular the fuselage (such as the fuselage skin), the stringers, the bulkheads, the circumferential frames, the wing skins, the stringers or stiffeners, the ribs and spars and the tail unit comprised in particular of horizontal and vertical stabilizers, as well as floor beams, seat tracks and doors.

According to the present invention, it has been discovered that by using a selected class of aluminum alloys that contain specific and important amounts of lithium, copper and magnesium and zirconium, wrought products are able to be prepared with an improved compromise between toughness and mechanical strength, and good corrosion resistance. In addition, these products, when they are subjected to an aging process chosen so as to obtain a yield strength $R_{p0.2}$ close to the peak yield strength $R_{p0.2}$, have excellent thermal stability.

The present inventors have surprisingly noted that according to embodiments of the present invention, it is possible to improve the compromise between the static mechanical resistance properties and the damage tolerance properties, in particular of thick aluminum-copper-lithium alloy products such as, in particular, alloy AA2050 by increasing the magnesium content. In particular, for thick products having been subjected to near-peak aging, the choice of copper, magnesium and lithium contents enables a favorable compromise of properties to be achieved, and satisfactory thermal stability of the product to be obtained.

The copper content of the products according to the invention is advantageously from 3.0 to 3.9% by weight. In an advantageous embodiment of the invention, the copper content is from 3.2 to 3.7% by weight. When the copper content is too high, the toughness may be insufficient, in particular for near-peak aging processes, and, moreover, the density of the alloy may not be advantageous. When the copper content is too low, the minimum static mechanical properties may not be capable of being achieved.

The lithium content of the products according to the present invention is advantageously from 0.8 to 1.3% by weight. Advantageously, the lithium content is from 0.9 to 1.2% by weight. Preferably, the lithium content is at least 0.93% by weight or even at least 0.94% by weight. When the lithium content is too low, the density reduction associated with the addition of lithium may be insufficient.

The magnesium content of the products according to the present invention is advantageously from 0.6 to 1.2% by weight and preferably from 0.65 or 0.67 to 1.0% by weight. In an advantageous embodiment of the present invention, the magnesium content is at most 0.9% by weight and preferably at most 0.8% by weight. For certain applications, it may be advantageous for the magnesium content to be at least 0.7%.

The zirconium content is advantageously from 0.05 to 0.18% by weight and preferably between 0.08 and 0.14% by weight so as to preferably obtain a fibrous or slightly recrystallized grain structure.

The manganese content is advantageously from 0.0 and 0.5% by weight. In particular in the production of thick sheets, the manganese content is preferably from 0.2 to 0.4% by weight which typically enables the toughness to be improved without compromising mechanical strength.

The silver content is advantageously from 0.0 to 0.5% by weight. The present inventors have noted that, although the presence of silver is advantageous, in the presence of a magnesium amount according to the present invention, a large amount of silver may not be necessary for obtaining an improvement desired in the compromise between the mechanical strength and the damage tolerance. The limitation of the amount of silver is generally economically highly favorable. In an advantageous embodiment of the invention, the silver content is from 0.15 to 0.35% by weight. In an embodiment of the present invention, which has the advantage of typically minimizing density, the silver content is preferably not more than 0.25% by weight.

The sum of the iron content and the silicon content is preferably not more than 0.20% by weight. Preferably, the iron and silicon contents are each not more than 0.08% by weight. In an advantageous embodiment of the present invention, the iron and silicon contents are at most 0.06 and 0.04% by weight, respectively. A controlled and limited iron and silicon content can contribute to an improvement in the compromise between mechanical strength and damage tolerance.

The alloy also advantageously contains at least one element capable of contributing to the control of the grain size selected from among Cr, Sc, Hf and Ti, with the amount of the element, if chosen, being between 0.05 and 0.3% by weight for Cr and for Sc, 0.05 to 0.5% by weight for Hf 0.01 to 0.15% by weight for Ti. Preferably, titanium is chosen in an amount of 0.02 and 0.10% by weight.

Zinc is an undesirable impurity. The zinc content is preferably Zn≤0.15% by weight and preferably Zn≤0.05% by weight. Zinc content is advantageously not more than 0.04% by weight.

The density of products according to the present invention is advantageously not more than 2.72 g/cm$^3$. To reduce the density of products, it may be advantageous to select the composition so as to obtain a density of not more than 2.71 g/cm$^3$ and preferably not more than 2.70 g/cm$^3$.

An advantageous alloy according to the present invention is particularly intended for producing thick, extruded, rolled and/or forged products. By thick products, in the context of the present invention, is intended products of which the thickness is at least 30 mm and preferably at least 50 mm. Indeed, an advantageous alloy according to the present invention preferably has a low quenching sensitivity, which is particularly advantageous for thick products.

Rolled products according to the present invention preferably have a thickness of from 30 to 200 mm and more preferably from 50 to 170 mm.

The thick products according to the present invention have a particularly advantageous compromise between mechanical strength and toughness.

A product according to the present invention, in a rolled state, solution treated, quenched and aged so as to reach near-peak yield strength, advantageously has, at half-thickness at least one of the following pairs of properties for thicknesses from 30 to 100 mm:

(i) for thicknesses of 30 to 60 mm, at half-thickness, a yield strength $R_{p0.2}$(L)≥525 MPa and preferably $R_{p0.2}$(L)≥545 MPa and a toughness $K_{1C}$ (L−T)≥38 MPa√m and preferably $K_{1C}$ (L−T)≥43 MPa√m, (ii) for thicknesses of 60 to 100 mm, at half-thickness, a yield strength $R_{p0.2}$(L)≥515 MPa and preferably $R_{p0.2}$(L)≥535 MPa and a toughness $K_{1C}$ (L−T)≥35 MPa√m and preferably $K_{1C}$ (L−T)≥40 MPa√m, (iii) for thicknesses of 100 to 130 mm, at half-thickness, a yield strength $R_{p0.2}$(L)≥505 MPa and preferably $R_{p0.2}$(L)≥525 MPa and a toughness $K_{1C}$ (L−T)≥32 MPa√m and preferably $K_{1C}$ (L−T)≥37 MPa√m, (iv) for thicknesses of 30 to 100 mm, at half-thickness, a yield strength $R_{p0.2}$(L) expressed in MPa and a toughness $K_{1C}$ (L−T) expressed in MPa√m so that $K_{1C}$ (L−T)≥−0.217 $R_{p0.2}$(L)+157 and preferably $K_{1C}$ (L−T)≥−0.217 $R_{p0.2}$(L)+163 and greater than 35 MPa (v) after thermal exposure for 1000 hours at 85° C., a tensile yield strength $R_{p0.2}$(L) and an elongation at rupture A % (L) having a difference with a tensile yield strength $R_{p0.2}$(L) and an elongation at rupture A % (L) before thermal exposure of less than 10%, and preferably less than 5%.

In another embodiment, thinner products, with a thickness comprised from 10 to 30 mm, typically around 20 mm, are however preferred because the compromise between mechanical strength and toughness in these conditions is particularly advantageous.

A product according to the present invention, in a rolled state, solution treated, quenched and aged so as to reach near-peak yield strength, advantageously has, at least one of the following pairs of properties at half-thickness for thicknesses from 10 to 30 mm:

(i) a yield strength $R_{p0.2}$(L)≥525 MPa and preferably $R_{p0.2}$(L) 545 MPa and a toughness $K_{1C}$ (L−T)≥40 MPa√m and preferably $K_{1C}$ (L−T)≥45 MPa√m, (ii) a yield strength $R_{p0.2}$(L) expressed in MPa and a toughness $K_{1C}$ (L−T) expressed in MPa√m so that $K_{1C}$ (L−T)≥−0.4 $R_{p0.2}$(L)+265 and preferably $K_{1C}$ (L−T)≥−0.4 $R_{p0.2}$(L)+270 and greater than 45 MPa√m, (iii) after thermal exposure for 1000 hours at 85° C., a tensile yield strength $R_{p0.2}$(L) and an elongation at rupture A % (L) having a difference with a tensile yield strength $R_{p0.2}$(L) and an elongation at rupture A % (L) before thermal exposure of less than 10%, and preferably less than 5%.

Products according to embodiments of the present invention also have advantageous properties in terms of fatigue behavior with regard to both crack initiation (S/N) and propagation rate (da/dN).

The corrosion resistance of the products of the present invention is generally high; thus, the MASTMAASIS test result (standards ASTMG85 & G34) is at least EA and preferably P for the products according to the present invention.

A suitable process for producing products according to the present invention includes steps of development, casting, hot working, solution treating, quenching and aging. A suitable process is described below.

In a first step, a liquid metal bath is prepared so as to obtain an aluminum alloy with a composition according to the invention.

The liquid metal bath is then cast as an unwrought shape, such as a billet, a rolling ingot or a forging stock.

The unwrought shape is then homogenized at a temperature of between 450° C. and 550° and preferably between 480° C. and 530° C. for a period of between 5 and 60 hours.

After homogenization, the unwrought shape is generally cooled to room temperature before being preheated so as to be hot worked. The preheating is intended to reach a temperature preferably between 400 and 500° C. and more preferably on the order of 450° C., enabling the raw product to be worked.

The hot working and optionally cold working is typically performed by extruding, rolling and/or forging, so as to obtain an extruded, rolled and/or forged product of which the thickness is preferably at least 30 mm. The product thus obtained is then solution heat treated by solution heat treatment at between 490 and 530° C. for 15 min to 8 hours, then typically quenched with water at room temperature or preferably with cold water. The product is then subjected to a controlled stretching with a permanent set of to 6% and preferably at least 2%. The rolled products are preferably subjected to controlled stretching with a permanent set of above 3%. In an advantageous embodiment of the invention, the controlled stretching is performed with a permanent set of between 3 and 5%. A preferred metallurgical temper is T84. Known steps such as rolling, flattening, straightening and forming can optionally be performed after solution heat treating and quenching and before or after the controlled stretching. In an embodiment of the invention, a step of cold rolling of at least 7% and preferably at least 9% is carried out before performing a controlled stretching with a permanent set of 1 to 3%.

Artificial aging is carried out, by heating at a temperature of between 130 and 170° C. and preferably between 150 and 160° C. for 5 to 100 hours and preferably for 10 to 40 hours so as to achieve a yield strength of $R_{p0.2}$ near the peak yield strength of $R_{p0.2}$.

It is known that, for alloys with age hardening such as Al—Cu—Li alloys, the yield strength increases with the artificial aging time at a given temperature to a maximum value called the hardening peak or "peak", then decreases with the aging time. In the context of this invention, the term aging curve will refer to the change in the yield strength as a function of the equivalent aging time at 155° C. An example of an aging curve is provided in FIG. 1. In the context of this invention, it is determined whether a point N on the aging curve, with an equivalent time at 155° C. $t_N$ and a yield strength of $R_{p0.2\ (N)}$ is close to the peak by determining the slope $P_N$ of the tangent to the aging curve at point N. In the context of this invention, the yield strength of a point N on the aging curve is considered to be close to the peak yield strength if the absolute value of the slope $P_N$ is at most 3 MPa/h. As shown in FIG. 1, an under-aged temper is a temper for which $P_N$ is positive and an over-aged temper is a temper for which $P_N$ is negative.

To obtain a value close to $P_N$, for a point N on the curve in an under-aged temper, the slope of the line passing through point N and through the preceding point N−1, obtained for a period $t_{N-1}<t_N$ and having a yield strength $R_{p0.2\ (N-1)}$, can be determined; we thus have $P_N \approx (R_{p0.2\ (N)}-R_{p0.2\ (N-1)})/(t_N-t_{N-1})$. In theory, the exact value of $P_N$ is obtained when $t_{N-1}$ tends toward $t_N$. However, if the difference $t_N-t_{N-1}$ is small, the variation in the yield strength risks being insignificant and the value imprecise. The present inventors have noted that a satisfactory approximation of $P_N$ is generally obtained when the difference $t_N-t_{N-1}$ is between 2 and 15 hours and is preferably on the order of 3 hours.

The equivalent time $t_i$ at 155° C. is defined by the formula:

$$t_i = \frac{\int \exp(-16400/T)dt}{\exp(-16400/T_{ref})}$$

where T (in Kelvin) is the instantaneous metal treatment temperature, which changes with time t (in hours), and $T_{ref}$ is a reference temperature set at 428 K. $t_i$ is expressed in hours. The constant Q/R=16400 K is derived from the activation energy for the diffusion of Cu, for which the value Q=136100 J/mol has been used.

The yield strength close to the peak yield strength is typically equal to at least 90%, generally even equal to at least 95% and frequently at least 97% of the peak yield strength $R_{p0.2}$. The maximum peak yield strength can be obtained by varying the time and temperature parameters of the aging. The peak yield strength is generally considered to be satisfactory when the aging time is varied between 10 and 70 h for a temperature of 155° C. after a stretching of 3.5%.

In general, for Al—Cu—Li alloys, the clearly under-aged tempers correspond to compromises between the static mechanical strength ($Rp_{0.2}$, $R_m$) and the damage tolerance (toughness, fatigue crack propagation resistance) that are better than at the peak and especially beyond the peak. However, the present inventors have noted that a near-peak under-aged temper may enable a beneficial damage tolerance to be obtained, while also improving the performance in terms of corrosion resistance and thermal stability.

In addition, the use of a near-peak under-aged temper can enable the robustness of the industrial process to be improved: a variation in the aging conditions leads to a low variation in the properties obtained.

It is thus advantageous to carry out a near-peak under-aging, i.e. an under-aging with time and temperature conditions equivalent to those of a point N on the aging curve at 155° C. so that the tangent to the aging curve at this point has a slope $P_N$, expressed in MPa/h, so that $0<P_N\leq 3$ and preferably $0.2<P_N\leq 2.5$.

Products according to the present invention can advantageously be used for example, in structural elements, in particular for airplanes. The use of a structural element incorporating at least one product according to the present invention and/or manufactured from such a product is advantageous, in particular for aeronautical construction. Products according to the present invention are particularly advantageous in the production of products machined from solids, such as in particular underwing or upper wing elements of which the skin and stringers are obtained from the same starting material, spars and ribs, as well as any other use in which these properties might be advantageous.

These aspects, as well as others of the invention, are explained in greater detail in the following illustrative and non-limiting examples.

EXAMPLES

Example 1

In this example, a plurality of slabs with dimensions 2000×380×120 mm of which the composition is provided in table 1 were cast.

TABLE 1

Composition in weight % and density of Al—Cu—Li alloys cast in plate form.

| | Si | Fe | Cu | Mn | Mg | Zn | Ag | Li | Zr | Density (g/cm$^3$) |
|---|---|---|---|---|---|---|---|---|---|---|
| 1 (Ref) | 0.012 | 0.022 | 3.54 | 0.38 | 0.32 | — | 0.24 | 0.89 | 0.10 | 2,706 |

TABLE 1-continued

Composition in weight % and density of Al—Cu—Li alloys cast in plate form.

| | Si | Fe | Cu | Mn | Mg | Zn | Ag | Li | Zr | Density (g/cm$^{3)}$ |
|---|---|---|---|---|---|---|---|---|---|---|
| 2 (Ref) | 0.012 | 0.023 | 3.53 | 0.38 | 0.32 | — | — | 0.91 | 0.10 | 2,699 |
| 3 (Inv) | 0.012 | 0.032 | 3.53 | 0.38 | 0.67 | — | 0.25 | 0.93 | 0.10 | 2,698 |
| 4 (Inv) | 0.011 | 0.022 | 3.5 | 0.38 | 0.67 | — | — | 0.94 | 0.10 | 2,692 |
| 5 (Ref) | 0.078 | 0.088 | 3.52 | 0.38 | 0.34 | — | 0.25 | 0.91 | 0.10 | 2,705 |
| 6 (Ref) | 0.015 | 0.029 | 3.50 | 0.39 | 0.31 | 0.39 | 0.24 | 0.95 | 0.10 | 2,707 |

(Ref: reference; Inv: invention).
Ti: target 0.02% by weight for alloys 1 to 6

The slabs were homogenized at around 500° C. for around 12 hours, then cut and scalped so as to obtain parts with dimensions of 400×335×90 mm. The parts were hot rolled to obtain plates with a thickness of 20 mm. The plates were solution treated at 505+/−2° C. for 1 h, quenched with water at 75° C. so as to obtain a cooling rate of around 18° C./s and thus simulate the properties obtained at half-thickness in a plate with a thickness of 80 mm. The plates were then stretched with a permanent elongation of 3.5%.

The plates were subjected to artificial aging for between 10 h and 50 h at 155° C. Samples were taken at half-thickness in order to measure the static mechanical tensile properties as well as the toughness $K_Q$. The test pieces used for measuring toughness had a width W=25 mm and a thickness B=12.5 mm. In general, the values of $K_Q$ obtained from this type of test piece are smaller than those obtained from test pieces having a greater thickness and width. Two measurements, obtained from test pieces with a width W=40 mm and a thickness B=20 mm, confirm this tendency. It may be believed that measurements obtained from even wider test pieces enabling valid measurements of $K_{1C}$ to be obtained would also be higher than the measurements obtained with the test pieces with a width W=25 mm and a thickness B=12.5 mm.

The results obtained are presented in table 2.

TABLE 2

Mechanical properties obtained for the different plates.

| Alloy | Aging time in hours at 155° C. | $Rp_{0.2}$ L (Mpa) | Rm L (Mpa) | A L (%) | $K_Q$ (MPa · m$^{1/2}$) L-T | Evaluation of the slope $P_N$ (MPa/h) |
|---|---|---|---|---|---|---|
| 1 | 0 | 302.6 | 392.8 | 15.6 | 39.4 | |
| | 14 | 481.4 | 519.8 | 13.2 | 51.2 | 12.8 |
| | 18 | 501.1 | 538.6 | 14.3 | 47.7 | 4.9 |
| | 18 | | | | 48.5* | |
| | 23 | 501.2 | 536.4 | 13.9 | 46.6 | 0.0 |
| | 36 | 509.6 | 544.8 | 13.4 | 45.8 | 0.6 |
| 2 | 0 | 300.6 | 393.6 | 15.5 | 30.7 | |
| | 14 | 442.2 | 489.9 | 14.2 | 44.0 | 10.1 |
| | 18 | 465.7 | 507.5 | 13.8 | 48.4 | 5.9 |
| | 23 | 474.0 | 513.0 | 13.0 | 46.2 | 1.7 |
| | 36 | 486.6 | 523.7 | 12.0 | 47.2 | 1.0 |
| 3 | 0 | 358.8 | 455.8 | 18.0 | — | |
| | 14 | 437.0 | 503.6 | 15.5 | 46.1 | 5.6 |
| | 18 | 488.4 | 532.1 | 13.2 | 44.4 | 12.9 |
| | 23 | 502.7 | 540.7 | 14.3 | 48.2 | 2.8 |
| | 23 | | | | 53.6* | |
| | 36 | 534.5 | 561.7 | 11.7 | 45.0 | 2.4 |
| | 40 | 535.5 | 563.7 | 12.5 | 43.6 | 0.2 |
| 4 | 0 | 361.6 | 449.8 | 14.2 | 34.1 | |
| | 14 | 408.7 | 487.9 | 15.6 | 41.3 | 3.4 |
| | 18 | 452.3 | 506.1 | 13.3 | 48.2 | 10.9 |
| | 23 | 469.6 | 515.2 | 12.8 | 45.5 | 3.5 |
| | 36 | 509.2 | 539.2 | 10.3 | 47.2 | 3.0 |
| 5 | 18 | 498.3 | 531.3 | 10.9 | 35.8 | |
| 6 | 0 | 310.3 | 403.9 | 15.5 | 36.3 | |
| | 14 | 512.5 | 549.2 | 12.7 | 41.2 | 14.4 |
| | 18 | 521.3 | 557.1 | 12.1 | 40.9 | 2.2 |
| | 23 | 526.3 | 561.0 | 11.7 | 39.8 | 1.0 |

*test piece with width W = 40 mm and thickness B = 20 mm.

Figure 2:
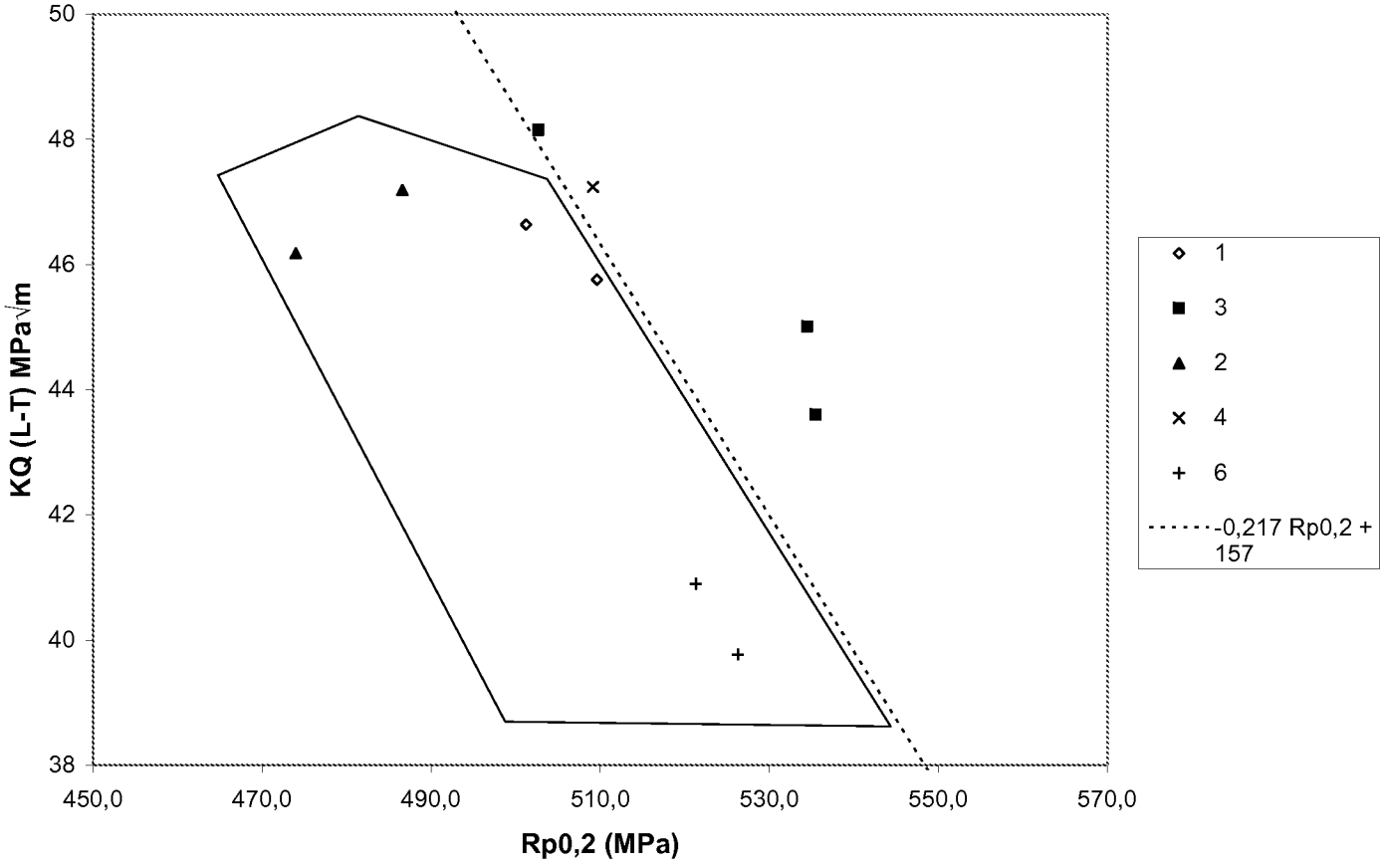
FIG. 2: Results of the yield strength and toughness obtained for the samples of example 1.

FIG. 2 shows the compromises in properties obtained for samples having a slope $P_N$ of between 0 and 3 and the measurements of toughness obtained with samples having a width W=25 mm and a thickness B=12.5 mm. The products according to the invention have a significantly improved compromise in properties over reference samples.

Example 2 (Reference)

In this example, a plurality of slabs with a thickness of 406 mm of which the composition is provided in table 3 were cast.

TABLE 3

Composition in weight % and density of Al—Cu—Li alloys cast in plate form.

| | Alloy | Si | Fe | Cu | Mn | Mg | Zn | Ag | Li | Zr | Density (g/cm$^3$) |
|---|---|---|---|---|---|---|---|---|---|---|---|
| 8 (Ref) | 2050 211183 | 0.03 | 0.06 | 3.51 | 0.41 | 0.3 | 0.02 | 0.37 | 0.84 | 0.09 | 2,713 |
| 9 (Ref) | 2195 176472 | 0.03 | 0.04 | 4.2 | | 0.4 | | 0.35 | 1.06 | 0.11 | 2,700 |
| 10 (Ref) | 2195 271257 | 0.03 | 0.05 | 3.87 | 0.02 | 0.31 | 0.01 | 0.35 | 1.06 | 0.11 | 2,695 |

The slabs were homogenized, then scalped. After homogenization, the slabs were hot rolled in order to obtain plates with a thickness of 50 mm. The plates were solution treated, quenched with cold water and stretched with a permanent elongation of between 3.5% and 4.5%

The plates were then subjected to aging for between 10 h and 50 h at 155° C. Samples were obtained at half-thickness in order to measure the static mechanical tensile properties as well as the toughness $K_Q$. The test pieces used to measure the toughness had a width W=80 mm and a thickness B=40 mm. The validity criteria of $K_{1C}$ were satisfied for certain samples. The results obtained are presented in table 4.

TABLE 4

Mechanical properties obtained for the different plates.

| | Aging time at 155° C. | Rm MPa | $Rp_{0.2}$ MPa | A (%) | $K_Q$ (MPa · m$^{1/2}$) L-T | $K_Q$ · (MPa m$^{1/2}$) T-L | Evaluation of the slope $P_N$ (MPa/h) |
|---|---|---|---|---|---|---|---|
| 8 | 15 | 531 | 494 | 10.1 | 46.0 ($K_{1C}$) | 37.4 ($K_{1C}$) | |
| | 18 | 534 | 498 | 10.0 | 46.1 ($K_{1C}$) | 35.7 ($K_{1C}$) | 1.2 |
| | 21 | 544 | 510 | 9.4 | 44.0 ($K_{1C}$) | 35.0 ($K_{1C}$) | 4 |
| | 24 | 543 | 508 | 10.4 | 44.2 ($K_{1C}$) | 35.4 ($K_{1C}$) | −0.5 |
| 9 | 20 | 628 | 605 | 7.4 | 23.4 | | |
| | 25 | 630.5 | 608.5 | 7.5 | 22.3 | | 0.7 |
| | 30 | 628 | 606 | 6.0 | 22.9 | | −0.5 |
| | 35 | 626 | 603 | 6.5 | 22.0 | | −0.6 |
| 10 | 0 | 410 | 311 | | 55.5 | | |
| | 10 | 568.5 | 529.5 | | 36.8 | | 21.8 |
| | 15 | 593 | 562 | | 30.4 | | 6.5 |
| | 20 | 594.5 | 562.5 | | 20.0 | | 0.1 |
| | 30 | 587.5 | 557.5 | | 27.0 | | −0.5 |
| | 45 | 613.5 | 587.5 | | 24.7 | | 2 |

Figure 3:
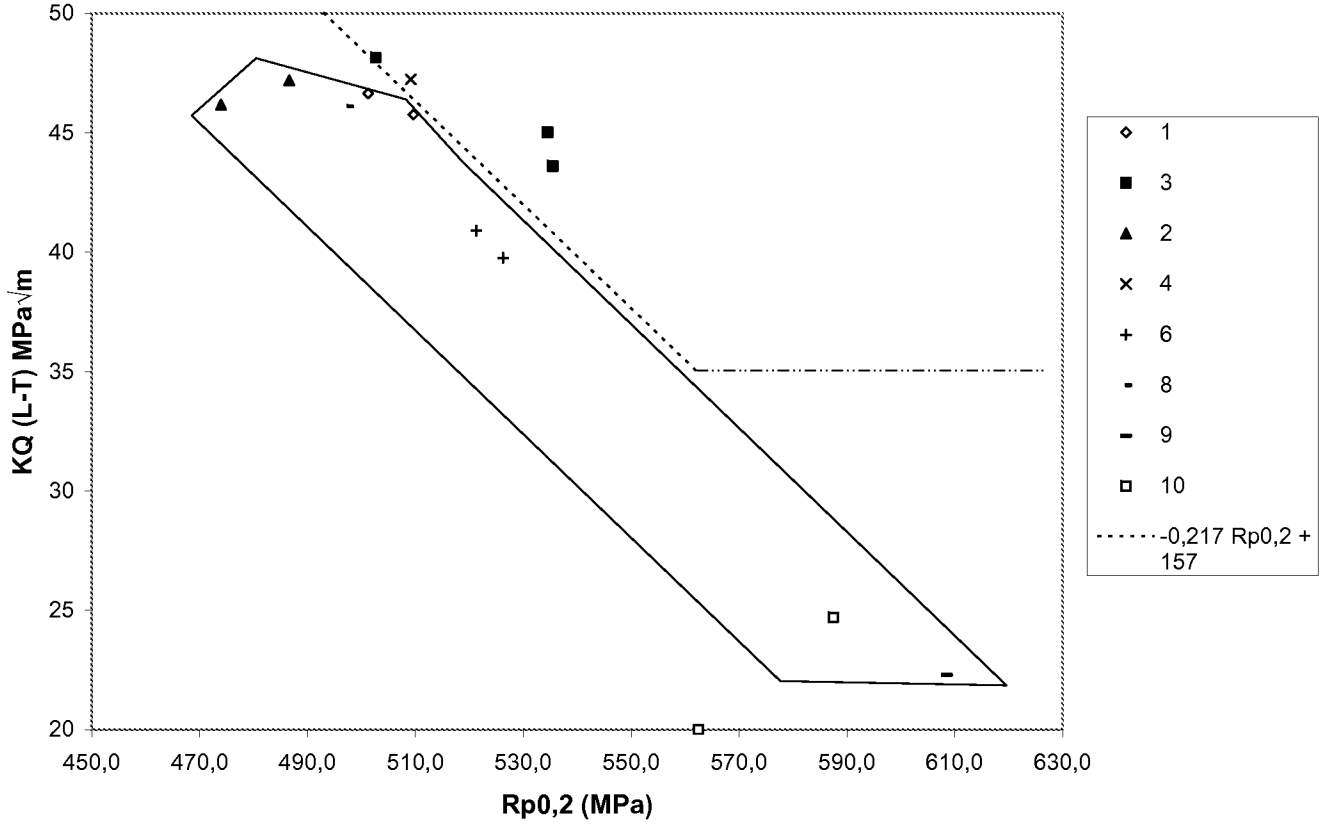
FIG. 3: Results of the yield strength and toughness obtained for the samples of examples 1 and 2, with the yield strength being close to the peak.

In FIG. 3, points 8, 9 and 10 have been added to FIG. 2 (slope $P_N$ between 0 and 3), although they concern test pieces of different shapes for the measurement of $K_Q$ ($K_{1C}$) so as to facilitate the comparison between the invention and the prior art. It is thus confirmed that the products according to the invention have an improved compromise in properties over the prior art.

Example 3

In this example, a plurality of slabs with dimensions 2000×380×120 mm of which the composition is provided in table 5 were cast.

TABLE 5

Composition in weight % and density of Al—Cu—Li alloys cast in plate form.

| | Si | Fe | Cu | Mn | Mg | Zn | Ag | Li | Ti | Zr | Density (g/cm$^3$) |
|---|---|---|---|---|---|---|---|---|---|---|---|
| 11 (Ref) | 0.035 | 0.059 | 3.56 | 0.35 | 0.32 | — | 0.25 | 0.90 | 0.03 | 0.11 | 2,706 |
| 12 (Inv) | 0.035 | 0.058 | 3.66 | 0.35 | 0.68 | — | 0.25 | 0.89 | 0.02 | 0.12 | 2,702 |
| 13 (Ref) | 0.036 | 0.059 | 3.57 | 0.34 | 1.16 | — | 0.25 | 0.86 | 0.02 | 0.12 | 2,697 |

(Ref: reference; Inv: invention).

The slabs were homogenized at around 500° C. for around 12 hours, then cut and scalped so as to obtain parts with dimensions of 400×335×90 mm. The parts were hot rolled to obtain plates with a thickness of 20 mm. The plates were solution treated at 505+/−2° C. for 1 h, and quenched with cold water. The plates were then stretched with a permanent elongation of 3.5%.

The plates were subjected to artificial aging for between 18 h and 72 h at 155° C. Samples were taken at half-thickness in order to measure the static mechanical tensile properties as well as the toughness $K_Q$. The test pieces used for measuring toughness had a width W=25 mm and a thickness B=12.5 mm.

The results obtained are presented in table 6.

TABLE 6

Mechanical properties obtained for the different sheets.

| Alloy | Aging time in hours at 155° C. | $Rp_{0.2}$ L (Mpa) | Rm L (Mpa) | A L (%) | $K_Q$ (MPa · m$^{1/2}$) L-T | Evaluation of the slope $P_N$ (MPa/h) |
|---|---|---|---|---|---|---|
| 11 | 18 | 512.8 | 543.2 | 13.2 | 54.7 | |
| | 36 | 521.4 | 550.4 | 12.2 | 50.7 | 0.5 |
| | 72 | 520.4 | 549.5 | 11.8 | 48.5 | 0.0 |
| 12 | 18 | 492.0 | 535.9 | 13.0 | 65.9 | |
| | 23 | 528.8 | 558.5 | 11.2 | | 6.7 |
| | 36 | 548.1 | 573.4 | 11.1 | 56.9 | 1.5 |
| | 40 | 555.7 | 579.7 | 10.8 | 56.6 | 1.9 |
| | 72 | 566.8 | 588.1 | 11.0 | 49.2 | 0.3 |
| 13 | 18 | 409.1 | 496.7 | 18.6 | 61.2 | |
| | 36 | 427.7 | 504.1 | 17.2 | 60.9 | 1.0 |
| | 72 | 502.2 | 537.5 | 13.3 | 53.4 | 2.1 |

Figure 4:
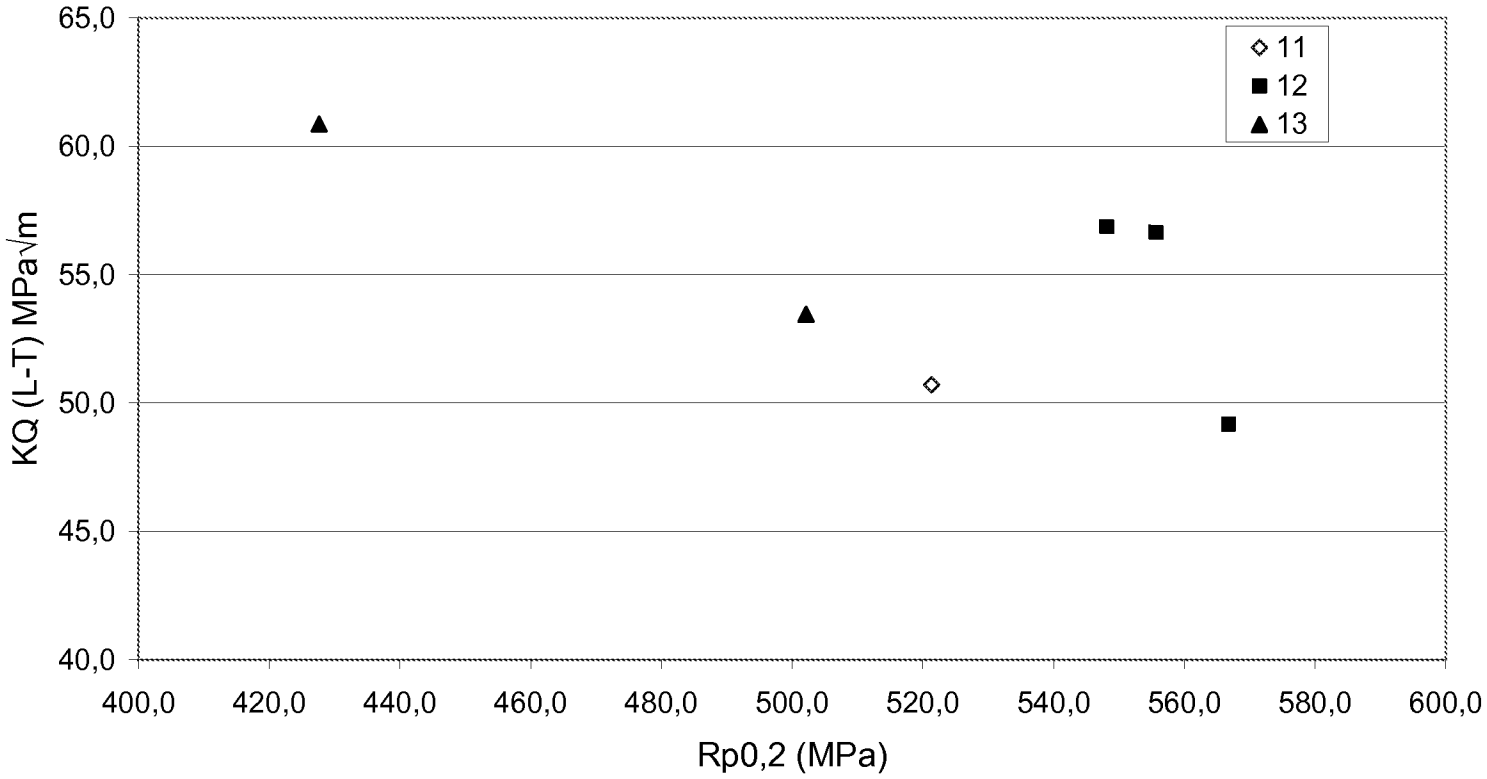
FIG. 4 Results of the yield strength and toughness obtained for the samples of example 3, with the yield strength being close to the peak.

FIG. 4 shows the compromises in properties obtained for samples having a slope $P_N$ of between 0 and 3 and the measurements of toughness obtained with samples having a width W=25 mm and a thickness B=12.5 mm. The products according to the invention have a significantly improved compromise in properties over reference samples.

Example 4

In this example, thermal stability of products made of alloy 12 were compared for different aging conditions.

Plates made of alloy 12 and manufactured according to the method described in example 3 until the artificial aging step excluded underwent artificial aging at 155° C. or at 143° C. for the increasing durations indicated in Table 7. Plates which were artificially aged 34 h at 143° C. or 40 h at 155° C. were subsequently thermally tested for 1000 hours at 85° C. Samples were taken at half-thickness in order to measure the static mechanical tensile properties before and after thermal exposure. Results are presented in Table 7. After aging 34 hours at 143° C., for which the slope $P_N$ was evaluated to 7.1 the plate does not exhibit satisfactory thermal stability. Thus after thermal exposure the tensile yield strength has increased 15% and elongation has decreased 13%. To the contrary, after aging 40 hours at 155° C., for which the slope $P_N$ is evaluated to 1.9 the plate exhibit a satisfactory thermal stability, with an evolution of those properties less than 5%.

TABLE 7

Mechanical properties obtained for plates made of alloy 12, before and after thermal exposure 1000 h at 85° C.

| | | Before thermal exposure 1000 h at 85° C. | | | Evaluation | After thermal exposure 1000 h at 85° C. | | |
|---|---|---|---|---|---|---|---|---|
| Aging temperature | Aging time (hours) | $Rp_{0.2}$ L (Mpa) | Rm L (Mpa) | A L (%) | of the slope $P_N$ (MPa/h) | $Rp_{0.2}$ L (Mpa) | Rm L (Mpa) | A L (%) |
| 155° C. | 23 | 528.8 | 558.5 | 11.2 | 6.7 | | | |
| | 36 | 548.1 | 573.4 | 11.1 | 1.5 | | | |
| | 40 | 555.7 | 579.7 | 10.8 | 1.9 | 564.3 | 578.0 | 10.2 |
| 143° C. | 20 | 368.0 | 472.7 | 17.2 | | | | |
| | 24 | 381.7 | 479.3 | 16.1 | 3.4 | | | |
| | 34 | 452.7 | 516.0 | 13.5 | 7.1 | 521.7 | 565.3 | 11.7 |

The invention claimed is:

1. An aluminum-based wrought product that is rolled and has a thickness from 10-130 mm, said product comprising, in weight %:

Cu: 3.5-3.7;
Li: 0.9-1.2;
Mg: 0.6-0.8;
Zr: 0.05-0.18;
Ag: 0.0-0.5;
Mn: 0.0-0.5;
Fe+Si≤0.20;
Zn≤0.15;
at least one element selected from the group consisting of: Ti: 0.01-0.15; Sc: 0.05-0.3; Cr: 0.05-0.3; Hf: 0.05-0.5;
other elements ≤0.05 each and ≤0.15 total, remainder aluminum;
wherein the composition is selected so as to obtain a density that is not more than 2.71 g/cm3,
which in a rolled state, solution treated, quenched and aged so as to obtain a near-peak yield strength, has, at half-thickness, at least one of the following pairs of properties:
for thicknesses from 10 to <30 mm: a yield strength Rp0.2(L)≥525 MPa and a toughness K1C (L−T)≥45 MPa√m,
for thicknesses of 30 to <60 mm: a yield strength Rp0.2 (L)≥525 MPa and a toughness K1C (L−T)≥43 MPa√m,
for thicknesses of 60 to <100 mm: a yield strength Rp0.2(L)≥520 MPa and a toughness K1C (L−T)≥40 MPa√m, or
for thicknesses of 100 to 130 mm, at half-thickness, a yield strength Rp0.2(L)≥510 MPa and a toughness K1C (L−T)≥37 MPa√m,
and wherein at least two properties of the product do not change more than 5% after thermal exposure of 1000 hours at 85° C., the at least two properties selected from the group consisting of: tensile yield strength Rp0.2 (L), ultimate tensile stress UTS (Rm L), and an elongation at rupture A % (L).

2. A product according to claim 1, wherein the magnesium content is from 0.65 to 0.8% by weight.

3. A product according to claim 1, wherein the manganese content is from 0.2 to 0.4% by weight.

4. A product according to claim 1, wherein the silver content is from 0.15 to 0.35% by weight.

5. A product according to claim 1, wherein the iron and silicon contents are each at most 0.08% by weight and/or in wherein the zinc content is ≤0.05% by weight.

6. A product according to claim 1, wherein the thickness is equal to at least 30 mm.

7. A structural element comprising a product according to claim 1.

8. An aeronautical construction comprising a structural element of claim 7.

9. An aeronautical construction according to claim 8 in which the structural element is an underwing or upper wing element of which skin and/or stringers can be obtained from the same starting product, a spar and/or a rib.

10. A product according to claim 1, which in a rolled state, solution treated, quenched and aged so as to obtain a near-peak yield strength, has, at half-thickness, at least one of the following pairs of properties:

for thicknesses from 10 to <30 mm: a yield strength Rp0.2(L)≥545 MPa and a toughness K1C (L−T)≥45 MPa√m,
for thicknesses of 30 to <60 mm: a yield strength Rp0.2 (L)≥545 MPa and a toughness K1C (L−T)≥43 MPa√m,
for thicknesses of 60 to <100 mm: a yield strength Rp0.2(L)≥535 MPa and a toughness K1C (L−T)≥40 MPa√m, or
for thicknesses of 100 to 130 mm, at half-thickness, a yield strength Rp0.2(L)≥525 MPa and a toughness K1C (L−T)≥37 MPa√m.

* * * * *